US005664505A

United States Patent [19]

Miyamoto et al.

[11] Patent Number: 5,664,505

[45] Date of Patent: Sep. 9, 1997

[54] METHOD OF AND APPARATUS FOR ABNORMALITY DETECTION OF A FLUIDIZED BED BOILER

[75] Inventors: Tomohiko Miyamoto, Takahagi; Yasuo Yoshii, Naka-machi; Tooru Inada, Hitachi; Jinichi Tomuro; Nobuyuki Hokari, both of Hitachinaka; Katsuya Oki, Hiroshima, all of Japan

[73] Assignees: Hitachi, Ltd.; Babcock-Hitachi Kabushiki Kaisha, both of Tokyo, Japan

[21] Appl. No.: 404,425

[22] Filed: Mar. 15, 1995

[30] Foreign Application Priority Data

Mar. 18, 1994 [JP] Japan ..... 6-48247

[51] Int. Cl.[6] ..... F23D 1/00

[52] U.S. Cl. ..... 110/347; 60/39.464; 60/39.02; 122/4 D; 110/188; 110/245; 110/234

[58] Field of Search ..... 122/4 D; 110/188, 110/347, 245, 263, 234; 60/39.182, 39.464, 39.02; 165/104.16

[56] References Cited

U.S. PATENT DOCUMENTS

| | | | |
|---|---|---|---|
| 4,744,212 | 5/1988 | Andersson et al. | 60/39.464 X |
| 4,767,315 | 8/1988 | Brannstrom et al. | 122/4 D X |
| 5,251,434 | 10/1993 | Sugita et al. | 60/39.182 |
| 5,526,582 | 6/1996 | Isaksson | 110/347 X |

*Primary Examiner*—Henry A. Bennett
*Assistant Examiner*—Susanne C. Tinker
*Attorney, Agent, or Firm*—Antonelli, Terry, Stout & Kraus, LLP

[57] ABSTRACT

A method of and apparatus for detecting an abnormality of a fluidized bed boiler is characterized in that an abnormality of the fluidized bed boiler is detected on the basis of a physical quantity related to a condition change of a gas existing in a space defined by a pressure vessel and the fluidized bed boiler accommodated within the pressure vessel.

12 Claims, 3 Drawing Sheets

METHOD OF AND APPARATUS FOR ABNORMALITY DETECTION OF A FLUIDIZED BED BOILER

BACKGROUND OF THE INVENTION

The present invention relates to a method of detecting and monitoring an abnormality of a pressurized fluidized bed combined cycle power plant and an apparatus therefor and, more particularly, to a method and apparatus suitable for detecting and monitoring an abnormality of a pressurized fluidized bed boiler.

In a pressurized fluidized bed combined cycle power plant, limestone which is a desulfurizing agent is fluidized at a pressure of 10 to 15 atm at a temperature of about 860° C., and fuel such as coal and air are supplied there to effect fluidized bed combustion of the coal. The heat of combustion is recovered by a heat exchanger tube, steam generated at that time drives a steam turbine, and combustion exhaust gas drives a gas turbine.

The part that coal is subjected to fluidized bed combustion and steam of high temperature and high pressure is generated is called a pressurized fluidized bed boiler. The pressurized fluidized bed boiler is accommodated within a pressure vessel, so that it is difficult to find an abnormality when it happens as compared with a conventional pulverized coal burning boiler. Further, in the pressurized fluidized bed boiler, heat exchanger tubes are installed, and it is feared that the tubes may be worn and torn to form an opening or through hole with limestone particles of several mm diameter which are fluidized violently. Strength reduction and through hole forming due to partial temperature elevation at a high temperature piping (there are two types one of which is a single tube type wherein an inside is fire insulating construction and the other is a double tube type wherein air is flowed in a space between inner and outer tubes to cool.) for introducing combustion exhaust gas from the pressurized fluidized bed boiler to the gas turbine become a problem.

The following is known as prior art: For the through hole formation, a method of detecting propagation of steam leak sound through a heat exchanger tube by an acoustic emission sensor (AE sensor) is proposed; In high temperature gas piping, development and putting into practice of a method of observing surface temperature of the tube by an optical fiber abnormally high temperature detection sensor and detecting an abnormality is being studied ([No.930-63] Japan Machinery Society the 71 Period National Ground Meeting Lecture Papers(Vol. D) (1993-10.2.4. Hiroshima)).

Although these prior arts are useful for detection of an abnormality, they have a weak point in abnormality detection under the following operation conditions:

For the AE sensor, in case a heat exchanger tube is in a fluidized bed, the steam leaked from the tube blows out fluid particles around the heat exchanger tube, and the particle impinges on the heat exchanger tube, whereby a signal level changes greatly more than in time of a normal operation. However, in case fluid particles do not exist around the heat exchanger tube, impingement of the particles does not occur, so that a signal level of the AE sensor is almost never different from a signal level at a time of normal operation and it is difficult to detect leakage of steam. In the pressurized fluidized bed boiler, load change is effected several times a day. Since the load change rises and lowers the height of the fluidized bed, fluid particles exist around all the heat conductive tube in an operation at 100% load and at a time of partial load operation a part of the heat conductive tube is out of the fluidized bed and particles do not exist around that part of the heat conductive tube. Therefore, the detection is difficult in such a case that steam leaks from the heat conductive tube outside the fluidized bed. Further, although in a high temperature gas piping, an optical fiber abnormally high temperature detection sensor is useful, it is necessary to provide an optical fiber, a laser apparatus.

Further, hitherto, means for detecting an abnormality such as bursting, damage, etc. of a pressurized fluidized bed boiler itself was not provided. In the pressurized fluidized bed boiler, also, the inner surface of the fluidized bed boiler is worn damaged by fluidized bed combustion of limestone, etc. In case destruction occurs in the fluidized bed boiler, the above-mentioned fluid particles are jetted out from the bursting and the particles accumulate on a lower portion of the pressure vessel.

By the way, the pressure vessel is designed so as to withstand a temperature of about 350° C. of compressed air which is burning air for the fluidized bed boiler and pressure of about 9.8 atm of the compressed air. When fluid particles of about 860° C. accumulate on the pressure vessel, the temperature of the pressure vessel exceeds the temperature limit that the pressure vessel can withstand, and the pressure vessel melts and can not withstand 9.8 atm. Therefore, there may occur such danger as an accident such as explosion of the pressure vessel and the fluidized bed boiler.

SUMMARY OF THE INVENTION

A first object of the present invention is to provide a method and apparatus in which, in particular, an abnormality of a fluidized bed boiler can be detected earlier in order to operate safely a pressurized fluidized bed power plant, and further it is to provide a method of and apparatus for stopping rapidly an operation of the pressurized fluidized bed power plant, particularly, the fluidized bed boiler.

A second object of the present invention is to provide a method of and apparatus for surely detecting an abnormality of a heat conductive tube, high temperature gas piping under any operation conditions, and further it is to provide a monitoring apparatus for stopping an operation of the plant and displaying an abnormal portion when any abnormality occurs therein.

A method of detecting an abnormality of a fluidized bed boiler relating to the present invention for carrying out the first object is characterized in that an abnormality of the fluidized bed boiler is detected on the basis of a physical quantity related to a condition change of a gas existing in a space defined by a pressure vessel and the fluidized bed boiler accommodated within the pressure vessel. The physical quantity relating to a gas condition change may be composition change of the gas, and it may be the concentration or a concentration change of a prescribed component in the gas. In this case, the prescribed component is at least one selected from a group consisting of $CO_2$, $O_2$, NOx and SOx.

Further, in case that the burning air supplied to the fluidized bed boiler is passed through a space defined by the pressure vessel and the fluidized bed boiler accommodated within the pressure vessel, the method is characterized in that an abnormality of the fluidized bed boiler is detected on the basis of a composition change of the burning air or the concentration or a concentration change of a predetermined component in the burning air. The prescribed composition is at least one selected from a group consisting of $CO_2$, $O_2$, NOx and SOx and, preferably, it is $CO_2$.

Further, another feature of the method of an abnormality of a fluidized bed boiler according to the present invention resides in that temperature of a lower end portion of a pressure vessel having therein the fluidized bed boiler is detected, and when the detection value exceeds a limit value, the fluidized bed boiler is judged to be abnormal.

Further, a method of monitoring a fluidized bed boiler to achieve the first object of the present invention is characterized in that when the concentration of a predetermined component in a burning air supplied to the fluidized bed boiler through a space defined by a pressure vessel and the fluidized bed boiler accommodated within the pressure vessel rises, the fluidized bed boiler is judged to be abnormal and an operation of the fluidized bed boiler is stopped at least.

A method of detecting an abnormality of a heat exchanger tube within a fluidized bed boiler relating to the present invention for carrying out the second object of the present invention is characterized in that an abnormality of the heat exchanger tube is detected on the basis of a composition change of combustion exhaust gas of the fluidized bed boiler or the concentration of a prescribed component in the combustion exhaust gas.

In this case, the prescribed component is at least one selected from a group consisting of $H_2O$, $CO_2$, $O_2$, NOx and SOx and, preferably, $H_2O$.

Further, a method of detecting an abnormality of double piping in a pressurized fluidized bed combined cycle power plant relating to the present invention for carrying out the second object of the present invention is a method of detecting an abnormality of double piping which has an inner tube connected to a fluidized bed boiler for introducing combustion exhaust gas of the fluidized bed boiler to a gas turbine, and an outer tube passing outside the inner tube and connected to a pressure vessel containing therein the fluidized bed boiler for introducing compressed air from a compressor to the pressure vessel, characterized in that the abnormality of the double piping is detected on the basis of a composition change of combustion exhaust gas flowing in the double piping or on the basis of the concentration or a change in concentration of a prescribed component in the combustion exhaust gas.

In this case, the prescribed component is at least one selected from a group consisting of $CO_2$, $O_2$, NOx and SOx and, preferably, it is $CO_2$.

An apparatus for executing a method of detecting an abnormality of a fluidized bed boiler to carry out the first object of the present invention is characterized by comprising detecting means for detecting a predetermined component in a gas flowing in a space defined by a pressure vessel and the fluidized bed boiler accommodated within the pressure vessel, and abnormality judging means for judging an abnormality of the fluidized bed boiler on the basis of a detection signal of the detecting means.

The detecting means may be constructed of a gas extraction tube for extracting a part of combustion air for the fluidized bed boiler flowing in a space defined by the pressure vessel and the fluidized bed boiler accommodated within the pressure vessel, and analyzing means for analyzing the concentration or a concentration change of a predetermined component in the burning air extracted through the gas extraction tube, or it may be a $CO_2$ sensor. It is preferable to install the detecting means on combustion gas piping for introducing burning air of the fluidized bed boiler flowing in the space defined by the pressure vessel and the fluidized bed boiler.

An apparatus for executing a method of detecting an abnormality of a heat exchanger tube in a fluidized bed boiler to carry out the second object of the present invention is characterized by comprising detecting means for detecting a predetermined component of combustion exhaust gas exhausted from the fluidized bed boiler, and abnormality judging means for judging an abnormality of the heat conductive tube on the basis of a detection signal of the detecting means.

In this case, the prescribed component may be $H_2O$.

Further, an apparatus for executing a method of detecting an abnormality of double piping to carry out the second object of the present invention is an apparatus for detecting an abnormality of the double piping which has an inner tube connected to a fluidized bed boiler for introducing combustion exhaust gas of the fluidized bed boiler to a gas turbine, and an outer tube passing outside said inner tube and connected to a pressure vessel containing therein the fluidized bed boiler for introducing compressed air from a compressor to the pressure vessel, characterized by comprising detecting means for detecting a predetermined component of combustion exhaust gas flowing in the inner tube, and abnormality judging means for judging an abnormality of the double piping on the basis of a detection signal of the detecting means.

In the apparatus having a dust separator provided on the inner tube for removing dusts in combustion exhaust gas from the fluidized bed boiler, it is preferable to detect a prescribed component of the combustion exhaust gas passing through the inner tube between the dust separator and the gas turbine.

The prescribed component in the above-mentioned apparatus for detecting an abnormality of a double piping may be $O_2$.

An apparatus for monitoring a pressurized fluidized bed boiler combined cycle power plant relating to the present invention to carry out the first and second objects of the present invention is characterized by comprising analysis means for analyzing the concentration or a concentration change of a predetermined component in each of compressed air passing through a space defined by a pressure vessel and a fluidized bed boiler and combustion exhaust gas of the fluidized bed boiler, abnormality judging means for outputting an abnormality signal when at least one of the concentration or the concentration change of the compressed air and the combustion exhaust gas analyzed by the analysis means and temperature at a lower end portion of the pressure vessel exceeds a limit value, and a monitoring means for receiving an output signal of the abnormality judging means and stopping said power plant, in particular, an operation of the fluidized bed boiler, and displaying an abnormal portion of the boiler, double piping, a heat conductive tube, etc. on the basis of the detection signal of the temperature, the concentration.

In case of display of an abnormal portion, the displaying means can be constructed so that the fluidized bed boiler, the double piping or the heat conductive tube is displayed corresponding to a component which exceeds the limit value.

As mentioned above, since the fluidized bed boiler is accommodated in the pressure vessel, when bursting takes place in the fluidized bed boiler, combustion exhaust gas leaks therefrom and enters the pressure vessel. In case the combustion exhaust gas leaks, first of all, conditions such as temperature, pressure, composition, concentration of a component, etc., of gas existing in the space defined by the pressure vessel and the fluidized bed boiler are influenced thereby. Therefore, by detecting a physical quantity concerning a condition change of the gas, an abnormality of the fluidized bed boiler can be detected or judged early.

The above-mentioned will be described more in detail.

In general, pressure in the fluidized beds boiler is 9.5 atm by average, however, since fluidized bed combustion is being effected, there is a change in pressure of about ±0.4 atm/2 seconds. Gas existing in the space formed by the pressure vessel and the fluidized bed boiler accommodated in the pressure vessel is burning air for the fluidized bed boiler and supplied from a compressor. The compressed air has a pressure of about 9.8 atm, which pressure is nearly equal to the pressure in the pressure vessel. That is, since the pressure in the fluidized bed boiler changes between 9.1 and 9.9 atm for a few seconds, when bursting occurs in the fluidized bed boiler, combustion exhaust gas in the boiler leaks and enters the pressure vessel for a few seconds. Further, the composition of the combustion exhaust gas is 73% $N_2$, 14% $CO_2$, 10% $H_2O$, 3% $O_2$, or so, NOx of a few content component is about 150 ppm, SOx is about 20 ppm, and the composition of the compressed air is nearly equal to one of atmosphere.

Therefore, when bursting occurs in the fluidized bed boiler, since NOx and SOx which almost do not exist in atmosphere flow in, an abnormality also can be detected by detecting those substances, or it also can be detected by detecting the concentration of $N_2$, $O_2$, the concentration of which lowers relatively with NOx, SOx flowed in.

In case detection is difficult because NOx, SOx is very small amount, the abnormality can be detected by detecting $CO_2$. As mentioned above, since the fluidized bed boiler uses coals as fuel, an exhaust amount of $CO_2$ is large, and about 14% $CO_2$ exists in the exhaust gas. On the other hand, the concentration of $CO_2$ in atmosphere is about 300 ppm, in case bursting occurs in the boiler, the concentration of $CO_2$ in the compressed air rises rapidly, so that an abnormality of the boiler can be detected easily and rapidly by detecting always and continuously the concentration of $CO_2$.

Further, when bursting occurs in the fluidized bed boiler, fluid particles of high temperature jet up from the bursting as well as the combustion exhaust gas and accumulate on the lower portion of the pressure vessel. The temperature of the fluid particles is about 880° C. as mentioned above, and the temperature of the lower end portion of the pressure vessel is about 350° C. which is nearly equal to the temperature of the compressed air, so that the abnormality of the fluidized bed boiler also can be detected by detecting always and continuously the temperature of the lower end portion of the pressure vessel.

In case the composition or the concentration of a prescribed component of the compressed air within the pressure vessel, it is preferable to detect it from combustion gas piping leading the compressed air in the pressure vessel to the fluidized bed boiler. Since almost all of the compressed air flowing in the surrounding of the fluidized bed boiler gathers in the combustion gas piping, an abnormality of the boiler can be detected, irrespective of abnormal portions of the fluidized bed boiler, by detecting the composition or the concentration of a prescribed component of the compressed air flowing in the combustion gas piping.

Further, detection of an abnormality of a heat exchanger tube in which steam circulated in the fluidized bed boiler flows can be effected by detecting the composition or the concentration of a prescribed component, of the combustion exhaust gas of the fluidized bed boiler.

As mentioned above, in case the pressurized fluidized bed boiler is operated normally, the composition of the combustion exhaust gas is 73% $N_2$, 14% $CO_2$, 10% $H_2O$, 3% $O_2$, and NOx and SOx of a few content component are measured about 150 ppm and about 20 ppm, respectively and the composition of the compressed air is nearly equal to one of atmosphere. However, when a bursting occurs in the heat exchanger tube and steam leaks from the bursting, the concentration of $H_2O$ in the combustion exhaust gas increases and the concentrations of the other components $N_2$, $CO_2$, $O_2$, NOx and SOx decrease. Therefore, detection of the concentration of these components enables detection of an abnormality of the heat exchanger tube. Further, by detecting only $H_2O$ the concentration of which increases particularly, the abnormality of the heat exchanger tube can be detected as well. By constructing as mentioned above, an abnormality of the heat exchanger tube can be detected precisely irrespective of the position of the fluidized bed boiler being changed due to load change.

In case that an abnormality of double piping which has an inner tube connecting a fluidized bed boiler and a gas turbine for leading combustion exhaust gas, and an outer tube passing outside the inner tube and connecting a pressure vessel and a compressor for leading compressed air is detected, the detection can be effected by detecting a composition change of, or a concentration change of a prescribed component in, combustion exhaust gas flowing in the inner tube. Since the pressure of the compressed air flowing in the outer tube is about 9.8 atm and the pressure of the exhaust combustion gas flowing in the inner tube is about 9.1 atm, when bursting occurs in the inner tube, the compressed air flowing in the outer tube penetrates into the inner tube and the composition of the combustion exhaust gas changes. Therefore, detection of a change in composition of the combustion exhaust gas flowing in the inner tube enables detection of an abnormality of the double piping, in particular, an abnormality of the inner tube. Further, since 21% $O_2$ exists in air and 3% $O_2$ exists in the combustion exhaust gas, if bursting occurs in the inner tube and the compressed air penetrates into the inner tube, the concentration of $O_2$ in the combustion exhaust gas increases. In a normal operation, there is a plus correlation between the concentration of $O_2$ and the concentration of NOx in the combustion exhaust gas. However, in case that air leaks as mentioned above, irrespective of the $O_2$ concentration being increased, the NOx concentration lowers and the $O_2$ concentration increases, so that an abnormality of the double piping, particularly, the inner tube can be detected easily and rapidly by detecting continuously the $O_2$ concentration.

Further, by providing a detector for detecting components in combustion exhaust gas or a gas extraction tube for extracting a part of the combustion exhaust gas and introducing it into an analysis means for gas components at a downstream side of a dust separator for separating dusts in the combustion exhaust gas, that is, between the dust separator and the gas turbine, detraction of detection preciseness, damage of detectors or chocking of the gas extraction tube, which may be caused by dusts in the combustion exhaust gas such as coal ashes, unburnt coals, desulphurizing agent, can be prevented.

When an abnormality occurs in at least one of the fluidized bed boiler, the double piping and the heat exchanger tube, an operation of the power plant is stopped. In particularly, when an abnormality occurs in the fluidized bed boiler, propagation of cracking of the fluidized bed boiler and an amount of fluid particles jetted out from the bursting can be suppressed to be minimum, an accident such as explosion of the pressure vessel and the fluidized bed boiler due to excess accumulation of the fluid particles can be prevented, and maintenance such as repairing after occurrence of an abnormality is easy even if it occurs.

DESCRIPTION OF THE EMBODIMENTS

Figure 1:
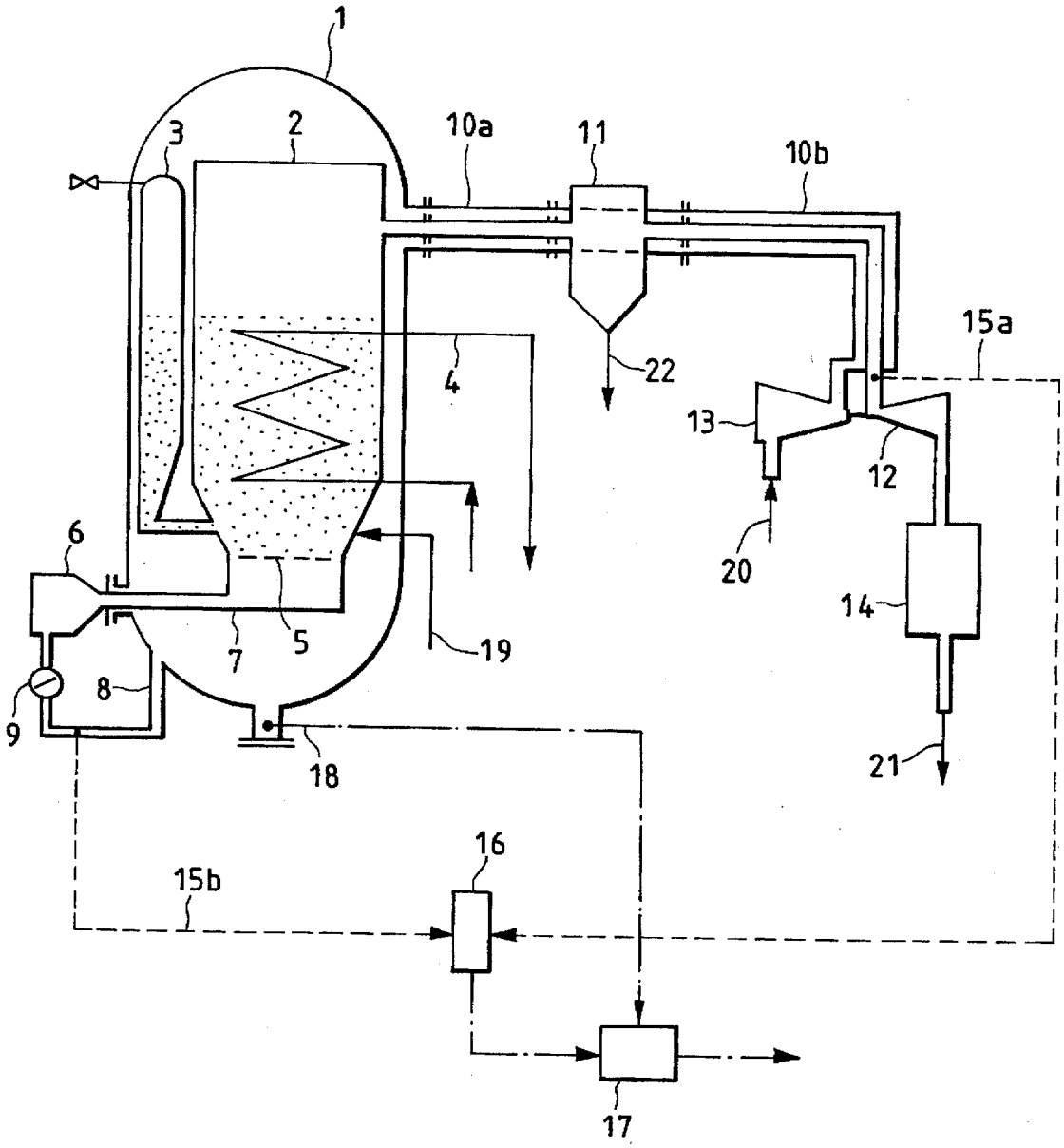
FIG. 1 is a schematic diagram of a monitoring apparatus of a pressurized fluidized bed boiler combined cycle power plant of a first embodiment of the present invention.

Embodiments of the present invention are explained hereunder in detail, referring to the drawings.

FIG. 1 is a schematic diagram of a monitoring apparatus of a pressurized fluidized bed boiler combined cycle power plant of a first embodiment of the present invention.

The power plant is constructed as follows:

In a pressure vessel 1, a fluidized bed boiler comprising a furnace 2 and a particle storage tank 3 are installed. The furnace 2 has a heat exchanger tube 4 therein, a distributor plate 5 at a lower portion thereof the lower side of which is connected to a wind box 7. The wind box 7 is fluidly connected to a start up furnace 6. The start up furnace 6 is fluidly connected to combustion gas piping 8 through a flow regulation valve 9. The combustion gas piping 8 is opened to the pressure vessel 1 at one end thereof. An upper portion of the furnace 2 is connected to a gas turbine 12 through high temperature gas piping (double tubes) 10*a*, a dust separator 11 and high temperature gas piping (double tubes). A waste heat recovery denitration apparatus 14 is provided at a downstream side of the gas turbine 12. A compressor 13 for gas for combustion (hereunder simply referred to as combustion gas), an electric generator (not shown), etc. are connected to the gas turbine 12. A gas extraction port for combustion exhaust gas is a downstream side of the high temperature gas piping 10*b* (double tubes) and an inlet side of the gas turbine 12. A gas turbine inlet receives a part of air from the compressor 13, however, a gas extraction port is disposed upstream of the air inlet. The gas extracted is transferred to a gas analyzer 16 through a gas extraction tube 15*a* and the concentration of $CO_2$, $H_2O$, NOx, $O_2$ is continuously analyzed there. An analysis signal is transmitted to an abnormality judgment apparatus 17 to judge an abnormality. On the other hand, a gas extraction port for combustion gas is on the combustion gas piping 8 at an upstream side of the flow regulation valve 9. Gas extracted from the gas extraction port is transmitted to the gas analyzer 16 through a gas extraction tube 15*b* and the concentration of $CO_2$, SOx, NOx is continuously analyzed there. The analysis signal is transmitted to the abnormality judgment apparatus 17 to judge an abnormality. A temperature measuring device 18 mounted on the bottom of the pressure vessel 1 continuously transmits signal to the abnormality judgment apparatus 17, and an abnormality is judged by the apparatus 17. Further, fuel and air are introduced through a fuel supply tube 19 and an air intake tube 20, respectively. Combustion exhaust gas from the heat recovery denitration apparatus 14 is introduced into a chimney through an exhaust gas outlet tube 21. Dusts collected by the dust separator 11 is taken out of the system through a discharge tube 22.

When the above-mentioned pressurized fluidized bed boiler combined cycle power plant is operated normally, the concentrations of $CO_2$, $H_2O$, $O_2$ and NOx in the combustion exhaust gas taken through the gas extraction tube 15*a* and analyzed by the gas analyzer 16 are about 14%, 10%, 3.6%, 150 ppm, respectively, and the NOx concentration and the $O_2$ concentration have a correlation. On the other hand, the concentrations of $O_2$, $CO_2$, SOx, NOx in the combustion exhaust gas taken through the gas extraction tube 15*b* and analyzed by the gas analyzer 16 are 21%, 300 ppm, 0 ppm (less than a measuring limit of the analyzer), 0 ppm (less than a measuring limit of the analyzer), respectively. Further, an indicated temperature of the temperature measuring device 18 mounted on the bottom of the pressure vessel 1 is 300° C. The signal is continuously inputted into the abnormality judgment apparatus 17.

Conditions of the compressed air and the combustion exhaust was when bursting (partial aperture) occurs in the furnace 2 are explained.

An average pressure in the furnace 2 is about 9.5 atm, but the pressure in the furnace 2 changes in a range of ±0.4 atm/2 seconds because of fluidized bed. On the other hand, a discharge pressure of the compressor 13 is 9.8 atm which is nearly equal to the pressure in the pressure vessel 1. That is, the pressure of a fluidized bed portion in the furnace 2 changes between 9.1 and 9.9 atm per a few seconds, so that when cracking occurs in the furnace 2, the combustion exhaust gas in the furnace 2 leaks and enters the pressure vessel for a few seconds. Therefore, in case that a partial aperture or through hole is formed in the furnace 2, the SOx concentration and the NOx concentration taken through the gas extraction tube 15*b* and analyzed by the gas analyzer 16 start simultaneously to rise from 0 ppm, as compared with the above normal values, and clearly reach concentration values above the measuring limit value of the analyzer. The $CO_2$ concentration also starts to rise from 300 ppm, a much higher concentration of $CO_2$ as compared with the $CO_2$ concentration existing usually in atmosphere is detected. Further, the $O_2$ concentration in the combustion exhaust gas taken through the gas extraction tube 15*a* and analyzed by the gas analyzer 16 becomes higher, the concentrations of $CO_2$, $H_2O$, $O_2$ and NOx lower. In particular, the correlation between the NOx concentration and the $O_2$ concentration is broken. Although during normal operation as the $O_2$ concentration increases, the NOx concentration increases proportionally thereto, the NOx concentration lowers irrespective of an increase in the $O_2$ concentration when the through hole is formed in the furnace 2. Further, the indicated temperature of the temperature measuring device 18 rises from 300° C. because the fluid particles (about 860° C.) jetted together with the leaked combustion exhaust gas reach to a lower end portion of the pressure vessel 1. The abnormality judgment apparatus 17 judges the absolute value, the change velocity, of each signal on the basis of these changes (compared with a limit value set in advance) displays the content of abnormality on an operation panel, a graphic display and outputs signals for effecting a stopping operation such as a decrease of, fuel supplied to the fuel supply tube 19, a water supply amount to the heat exchanger tube 4 and opening of an inlet valve of the compressor 13. The order of the stopping operation is explained.

As mentioned above, if the cracking of the furnace 2 is left as it is, reduction in the durability of the pressure vessel 1 because of accumulation of high temperature fluid particles, and explosion of the pressure vessel 1 and the furnace 2 due to the reduction of the durability are feared, so that it is necessary to rapidly and early stop the operation of the furnace 2 when an abnormality occurs in the furnace 2. In the stop operation at this time, first of all, supply of fuel (coal) as a heat source is stopped, and then supply of air is stopped to reduce the pressure within the furnace 2.

Further, at a time of starting, the abnormality judgment apparatus is released from an operation because temperature and combustion exhaust gas composition each have a different value. Further, the apparatus also can be constructed so that signals to be outputted from the abnormality judgment apparatus 17 are output when either one of the above-mentioned concentration and the temperature exceeds a limit value, or it can be constructed so that the signal is output when both of the concentration and the temperature exceed the limit values. Further, the above-mentioned $CO_2$ is contained more in the combustion exhaust gas than in the combustion air, has a higher concentration in the combustion exhaust gas, and is contained more in the combustion exhaust gas than SOx, NOx. Therefore, an abnormality of the furnace 2 can be detected by measuring only the $CO_2$ concentration. A limit value with which measured values of concentration in this case are compared is determined about 350 ppm, considering a change (300 ppm±20 ppm) in concentration in air, for instance. As for SOx, NOx, since the concentration of each of them is less than 1 ppm, a limit value is determined 2 ppm or less, for example. A limit value of the temperature in the lower end portion of the pressure vessel 1 is determined on the basis of the temperature of compressed air discharged from the compressor 13. For example, when the temperature of the compressed air is 350° C., the limit value is determined about 360° C., considering measurement error (±4° to 6° C.) of the temperature measuring device.

Next, a case that cracking occurs in the heat exchanger tube is explained.

When the heat exchanger tube has a through hole made therein, steam leaks from the heat exchanger tube 4 and enters the furnace 2, so that the concentration of $H_2O$ in the combustion exhaust gas taken out through the gas extraction tube 15*a* and analyzed by the gas analyzer 16 becomes higher, and the concentrations of $CO_2$, $O_2$, NOx lower (a ratio of NOx/$O_2$ almost does not change). Further, both the composition of the combustion gas taken out through the gas extraction tube 15*b* and analyzed by the gas analyzer 16 and the signal of the temperature measuring device installed on the bottom of the pressure vessel 1 do not change. In this case, the abnormality judgment apparatus 17 displays an abnormality of the heat exchanger tube on an operation panel, a graphic display and outputs signals of stop operations such as restriction of fuel supplied to the fuel supply tube 19 and an amount of water supplier to the heat exchanger tube 4, decrease of an opening of the inlet valve of the compressor 13.

Of course, it can be constructed so that only $H_2O$ is detected, the concentration thereof is compared with a predetermined limit value and an abnormality signal is output when the concentration exceeds the limit value. In this case, considering the change in concentration of $H_2O$ in the combustion exhaust gas, the limit value is determined a value larger than an allowable value (a maximum value of $H_2O$ in usual time) including the change range, at least.

Further, a case that a bursting occurs in the high temperature gas piping (double tubes) is explained.

Since the pressure of compressed air flowing outside the high temperature gas piping (double tubes) is about 9.8 atm, the pressure of combustion exhaust gas in the inside thereof is 9.1 atm, when a bursting occurs in the inside of the double tubes, the compressed air flowing in the outside flows in the side of the combustion exhaust gas flowing inside the double tubes. Therefore, when a through hole is formed in the inside of the double tubes 10*a*, 10*b*, the concentration of $O_2$ in the combustion exhaust gas taken out through the gas extraction tube 15*a* and analyzed by the gas analyzer 16 becomes higher, the concentrations of $CO_2$, $H_2O$, NOx become lower (it is the same as the above-mentioned concentration change). However, both the composition of gas in the combustion gas taken out through the gas extraction tube 15*b* and analyzed by the gas analyzer 16 and the signal of the temperature measuring device installed on the bottom of the pressure vessel 1 do not change. In this case, the abnormality judgment apparatus 17 displays an abnormality of the high temperature gas piping (double tubes) on an operation panel, a graphic display and outputs signals of stop operations such as restriction of fuel supplied to the fuel supply tube 19 and an amount of water supplied to the heat exchanger tube 4, decrease of an opening of the inlet valve of the compressor 13.

The above-mentioned limit value of the $O_2$ concentration also is determined, considering a concentration change in air in the same manner as $CO_2$ mentioned above.

Figure 2:
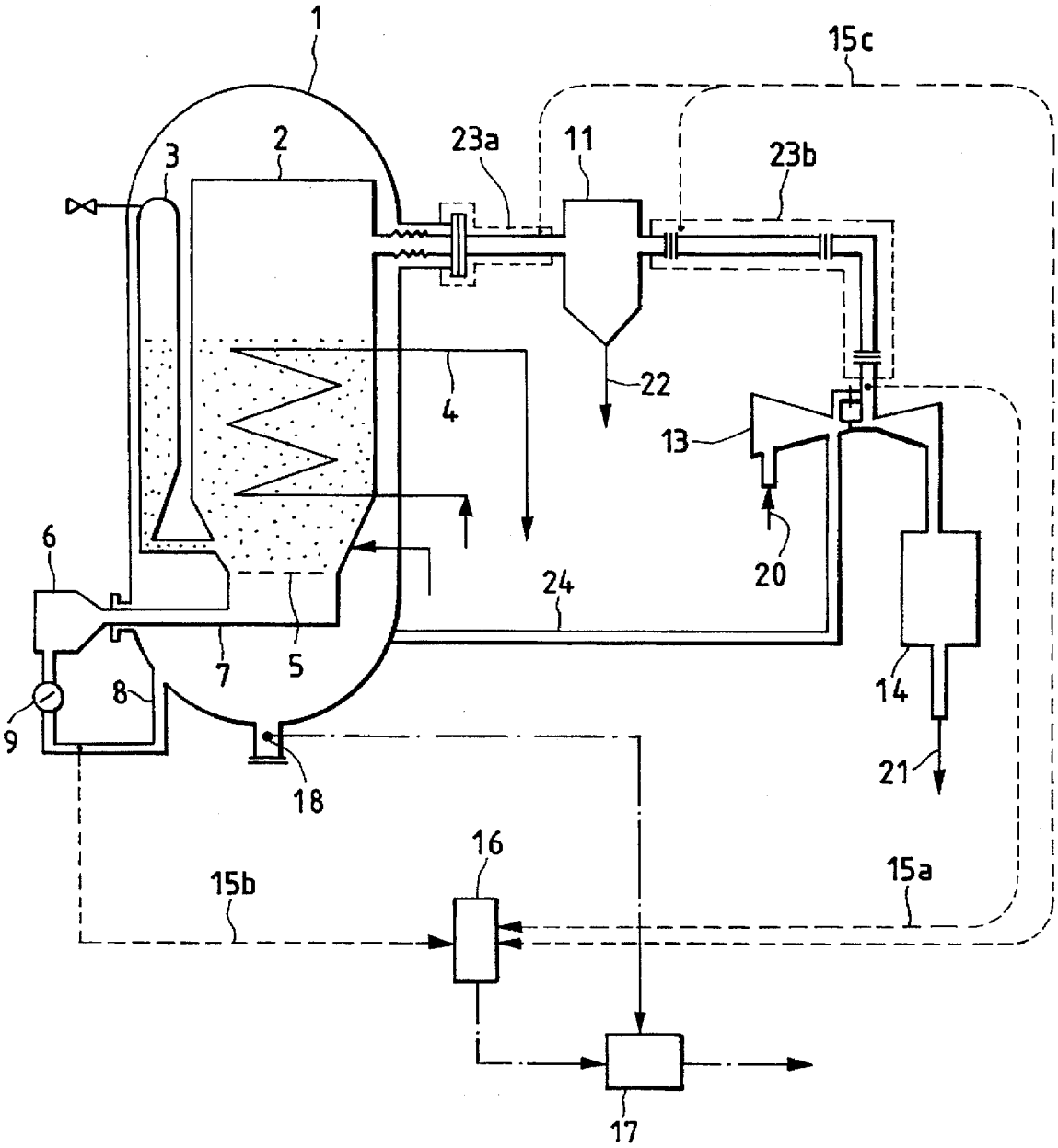
FIG. 2 is a schematic diagram of a monitoring apparatus of a pressurized fluidized bed boiler combined cycle power plant of a second embodiment of the present invention.

FIG. 2 shows a second embodiment of the present invention, it is a schematic diagram for explaining a monitoring method of a pressurized fluidized bed boiler combined cycle power plant in which a single tube is used for a high temperature gas piping between an outlet of a furnace 2 and gas turbine inlet. Reference numbers in FIG. 2 correspond to ones in FIG. 1, a basic construction is the same as in FIG. 1. Differences are that a single tube 23*a*, 23*b* are provided as a high temperature gas piping between an outlet of the fir furnace 2 and the gas turbine inlet, and that air from the compressor 13 is supplied into the interior of the pressure vessel 1 through an air piping 24.

In case that the single tube is provided for the high temperature gas piping, an outside of the high temperature gas piping is covered with a plate, etc. which can separate from atmosphere, gas in a space surrounded by the high temperature gas piping and the cover is continuously extracted through a gas extraction tube 15*c* and the concentrations of $CO_2$, NOx, SOx are analyzed by the gas analyzer 16. When a through hole is formed in the high temperature gas piping, the concentrations of $CO_2$, NOx and SOx become higher. The abnormality judgment apparatus 17 displays an abnormality of the high temperature gas piping (single tube) on an operation panel, a graphic display and outputs signals of stop operations such as restriction of fuel supplied to the fuel supply tube 19 and an amount of water supplied to the heat exchanger tube 4, an decrease of an opening of the inlet valve of the compressor 13. Further, continuous analysis of extracted gas through the gas extraction tube 15*a*, 15*b* and analyzed by the gas analyzer 16, and judgment functions by the abnormality judgment apparatus 17 on the basis of the temperature measured by the temperature measuring device 18 are the same as described in the first embodiment. Further, gas to be extracted continuously through the gas extraction tube 15*c* and analyzed by the gas analyzer 16 are not only $CO_2$, NOx, SOx, but may be components such as $N_2O$, CO which are included in the combustion exhaust gas but not included in air.

The gas extraction tube 15*a* can be provided with a valve for reducing pressure, a flow control mechanism for extracting a fixed amount of gas and a heat keeping mechanism for $H_2O$ analysis. The other gases $CO_2$, $O_2$, NOx, SOx are introduced into the gas analyzer 16 through a drain separator. The gas extraction tube 15*b* also can be provided with a valve for pressure reduction, a flow control mechanism for extracting a fixed amount of gas. The gas extraction tube 15*c* can be provided with a flow control mechanism for extracting a fixed amount of gas by a suction apparatus.

An abnormality detecting method of the furnace 2, the heat exchanger tube 4 is the same as in the first embodiment.

Figure 3:
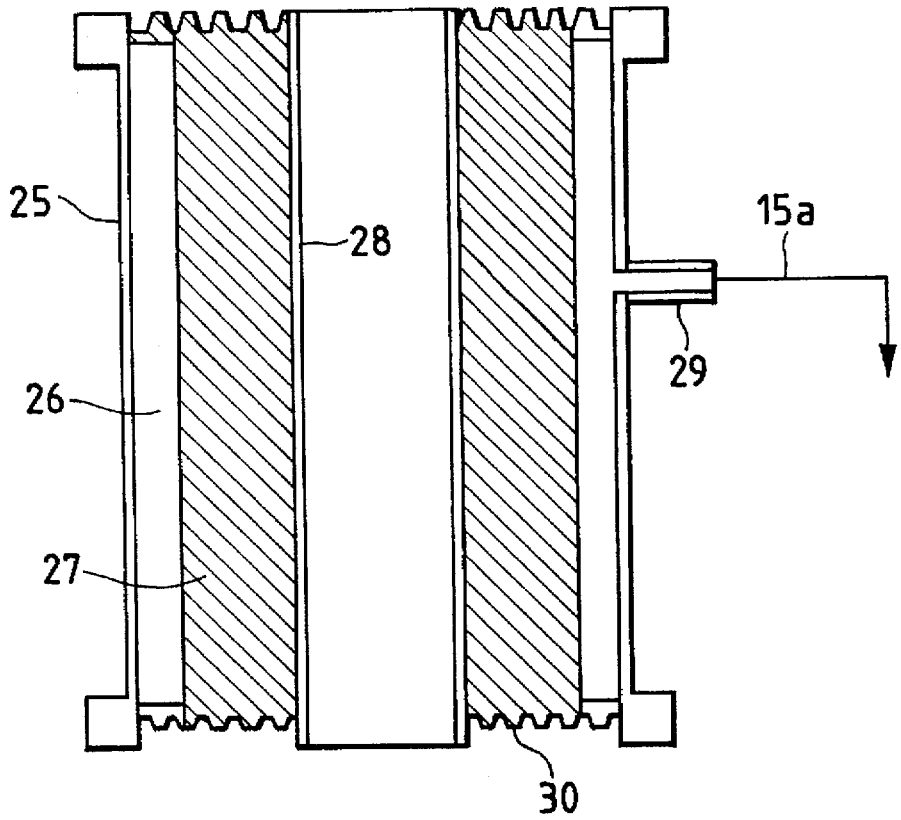
FIG. 3 is a vertical sectional view of a high temperature gas piping (a single tube) adapted for the present invention.
Figure 4:
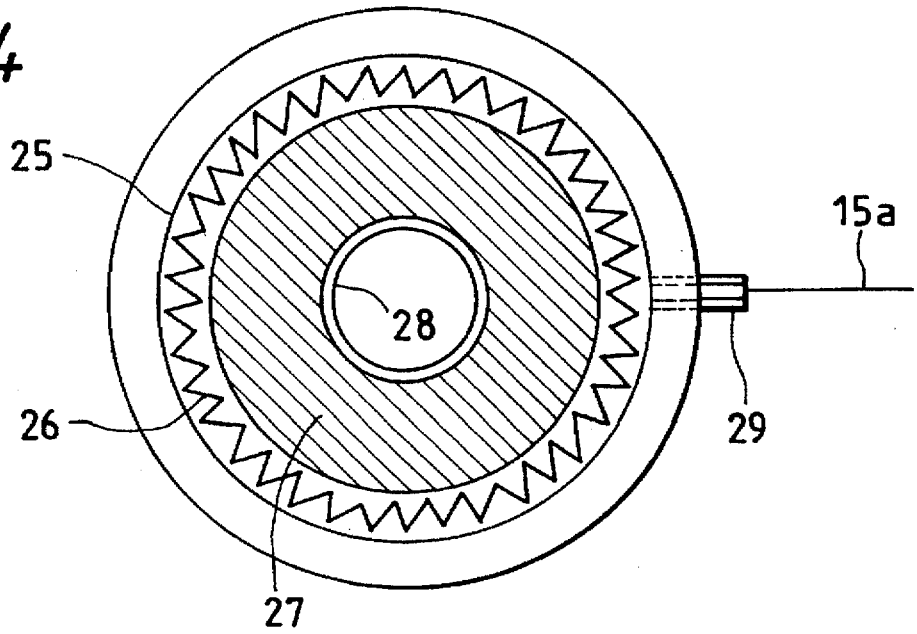
FIG. 4 is a plan view of FIG. 3.

FIGS. 3 and 4 show a modification of the high temperature piping (single tube). The outer surrounding of the tube is not covered with a cover but an inner tube 26 is sealingly connected to the interior of a pressure resistant tube 25. Fireproof material 27 is inserted in the inside thereof and a sleeve 28 is inserted in the fireproof material 27. Gas seal plates 30 are secured to an inlet and an outlet of the high temperature piping (single pipe). A gas extraction port 29 is arranged for continuously extracting gas from a space defined by the pressure resistant tube 25 and the inner tube 26, and the gas extraction tube 15*a* is connected to the gas extraction port 29. A pump which can suck at −200 mm Aq is connected to the gas extraction tube 15*a* to continuously extract gas from the space. Since gas does not penetrate into the space in the normal operation, the pressure in the space is kept −200 mm Aq. When high temperature gas flowing in the sleeve 28 contacts the inner tube 26, heats the tube 26 or makes a through hole in the tube by an abnormality such as through hole forming in the sleeve 28, cracking in the insulation material 27, the suction pressure lowers and further, the concentration of $CO_2$ in the sucked gas becomes higher than in the normal operation. In this case, in the same manner as in the second embodiment, the abnormality judgment apparatus 17 displays an abnormality of the high temperature gas piping (single tube) on an operation panel, a graphic display and outputs signals of stop operations such as restriction of fuel supplied to the fuel supply tube 19 and an amount of water supplied to the heat exchanger tube 4, decrease of an opening of the inlet valve of the compressor 13, and the operation is stopped.

Further, a mixture of a substance decomposing at about 300° C. and generating gas and a heat insulating material can be filled in the space sealingly formed between the pressure resistant tube 25 and the inner tube 26 and it can be sufficient to continuously monitor the concentration of the decomposed gas.

Since the present invention is, based on composition change of the combustion exhaust gas, composition change of the combustion gas and temperature change at a particular position, as a fundamental principle. Any measuring device for each component can be used. For example, if an $O_2$ analyzer which can be used under high temperature is used, a concentration change can be detected without extraction of gas to be measured, so that a response performance can be raised. Further, if analysis of very small amount gas composition will be possible in future, an abnormal phenomena can be found earlier by detecting radical components of intermediate products. Further, without restricting sampling positions to several positions, judgment of abnormality occurrence position becomes easy by providing a plurality of sampling positions in a gas flow direction. In the temperature measurement, also, a thermocouple if it is set to a position in the pressure vessel at which particles fall and collects, an infrared thermometer using non-contact type optical fiber, an infrared camera measuring at the outside of the pressure vessel, etc. can be used.

According to the present invention, since combustion exhaust gas composition ($CO_2$, $O_2$, $H_2O$, NOx, SOx), combustion gas composition, temperature of a pressure vessel lower portion, is continuously detected to judge an abnormality, an abnormality of apparatus and devices such as a boiler, a heat exchanger tube, etc. can be detected earlier. Further, since an operation of power plant can be stopped according to the abnormality, occurrence of an accident due to development of an abnormality of the boiler can be prevented, and safety in the pressurized fluidized bed combined cycle power plant is improved further.

What is claimed is:

1. A method of detecting an abnormality of a fluidized bed boiler, characterized in that an abnormality of the fluidized bed boiler is detected on the basis of a composition change of a gas existing in a space defined by a pressure vessel and the fluidized bed boiler accommodated within the pressure vessel.

2. A method of detecting an abnormality of a fluidized bed boiler, characterized in that an abnormality of the fluidized bed boiler is detected on the basis of a detected concentration value of a predetermined component in a gas existing in a space defined by a pressure vessel and the fluidized bed boiler accommodated within the pressure vessel.

3. A method according to claim 2, wherein the predetermined component in said gas is at least one selected from a group consisting of $CO_2$, $O_2$, NOx and SOx.

4. A method of detecting an abnormality of a fluidized bed boiler, characterized in that an abnormality of the fluidized bed boiler is detected on the basis of a composition change of combustion air supplied to the fluidized bed boiler through a space defined by a pressure vessel and the fluidized bed boiler accommodated within the pressure vessel.

5. A method of detecting an abnormality of a fluidized bed boiler, characterized in that a concentration of $CO_2$ in a combustion air supplied to the fluidized bed boiler through a space defined by a pressure vessel and the fluidized bed boiler accommodated within the pressure vessel, and when the detection value exceeds a limit value, the fluidized bed boiler is judged to be abnormal.

6. A method of monitoring a fluidized bed boiler, characterized in that a concentration of a predetermined component in a combustion air supplied to the fluidized bed boiler through a space defined by a pressure vessel and the fluidized bed boiler accommodated within the pressure vessel, and when the fluidized bed boiler is judged to be abnormal on the basis of the detection value, an operation of the fluidized bed boiler is stopped.

7. A method of detecting an abnormality of heat exchanger tubes in which steam flows to circulate within a fluidized bed boiler, characterized in that an abnormality of the heat exchanger tubes is detected on the basis of a concentration of a predetermined component in a combustion exhaust gas of the fluidized bed boiler.

8. A method according to claim 7, wherein the predetermined component is at least one selected from a group consisting of $H_2O$, $CO_2$, $O_2$, NOx and SOx.

9. A method of detecting an abnormality of heat exchanger tubes in which steam flows to circulate within a fluidized bed boiler and monitoring the fluidized bed boiler, characterized in that a concentration of a predetermined component in a combustion exhaust gas of the fluidized bed boiler is detected, and when an abnormality of the heat exchanger tubes is detected on the basis of the detection value, an operation of the fluidized bed boiler is stopped.

10. A method of detecting an abnormality of a fluidized bed boiler, characterized in that an abnormality of the fluidized bed boiler is detected on the basis of a concentration of a predetermined component in said combustion air supplied to the fluidized bed boiler through a space defined by a pressure vessel and the fluidized bed boiler accommodated within the pressure vessel.

11. A method according to claim 10, wherein the predetermined component in said combustion air is at least one member selected from the group consisting of $CO_2$, $O_2$, NOx and SOx.

12. A method of detecting an abnormality of a fluidized bed boiler contained within a pressure vessel, characterized in that temperature within a lower end portion of the pressure vessel is detected, and when the detection value exceeds a limit value, the fluidized bed boiler is judged to be abnormal.

* * * * *